US011911819B2

(12) United States Patent
Nakada et al.

(10) Patent No.: US 11,911,819 B2
(45) Date of Patent: Feb. 27, 2024

(54) SHAPING METHOD AND SHAPING DEVICE FOR DOUBLE PIPE

(71) Applicant: FUTABA INDUSTRIAL CO., LTD., Okazaki (JP)

(72) Inventors: Yuji Nakada, Okazaki (JP); Koichiro Yamamoto, Okazaki (JP)

(73) Assignee: Futaba Industrial Co., Ltd., Okazaki (JP)

( * ) Notice: Subject to any disclaimer, the term of this patent is extended or adjusted under 35 U.S.C. 154(b) by 0 days.

(21) Appl. No.: 18/146,695

(22) Filed: Dec. 27, 2022

(65) Prior Publication Data

US 2023/0264247 A1 Aug. 24, 2023

(30) Foreign Application Priority Data

Feb. 24, 2022 (JP) ..... 2022-027105

(51) Int. Cl.
*B21D 9/05* (2006.01)
*B21D 9/04* (2006.01)

(52) U.S. Cl.
CPC ..... *B21D 9/05* (2013.01); *B21D 9/04* (2013.01)

(58) Field of Classification Search
CPC . B21D 7/024; B21D 7/03; B21D 7/04; B21D 7/08; B21D 9/01; B21D 9/03; B21D 9/04; B21D 9/05; B21D 9/07; B21D 9/073; B21D 9/12; B21D 9/16
See application file for complete search history.

(56) References Cited

U.S. PATENT DOCUMENTS 1,598,893 A * 9/1926 James ..... B21D 9/05 285/179
3,190,103 A * 6/1965 Doyle ..... B21D 9/073 72/388

(Continued)

FOREIGN PATENT DOCUMENTS

EP 0268891 A1 6/1988
JP S5732831 A 2/1982
JP H0287512 U 7/1990

(Continued)

OTHER PUBLICATIONS

Notice of Reasons for Refusal (Office Action) in Japanese Patent Application No. 2022-027105 dated Dec. 19, 2023 (4 pages including English translation).

*Primary Examiner* — Teresa M Ekiert
(74) *Attorney, Agent, or Firm* — Withrow + Terranova, PLLC; Vincent K. Gustafson

(57) ABSTRACT

A shaping method for a double pipe includes: bending the double pipe with a specified curvature to form a bent portion in the double pipe; and arranging the bent portion on a first shaping die having a first shaping surface at a position biased inward or outward in a curvature radius direction of the bent portion relative to the first shaping surface, wherein the first shaping surface is configured to shape a first outer surface of both outer surfaces of the bent portion that are located on both sides of a plane including a central axis of the bent portion, and pressing the bent portion arranged on the first shaping die by a second shaping die having a second shaping surface configured to shape a second outer surface of the both outer surfaces of the bent portion.

5 Claims, 8 Drawing Sheets

(56) References Cited

U.S. PATENT DOCUMENTS

| | | | | |
|---|---|---|---|---|
| 4,137,743 | A * | 2/1979 | Schwarze | B21D 9/073 29/455.1 |
| 2021/0316351 | A1 | 10/2021 | Yamamoto et al. | |

FOREIGN PATENT DOCUMENTS

| | | | |
|---|---|---|---|
| JP | 2005074508 | A | 3/2005 |
| JP | 3983211 | B2 | 9/2007 |
| JP | 2021167015 | A | 10/2021 |

* cited by examiner

SHAPING METHOD AND SHAPING DEVICE FOR DOUBLE PIPE

CROSS-REFERENCE TO RELATED APPLICATIONS

This application claims the benefit of Japanese Patent Application No. 2022-027105 filed on Feb. 24, 2022 with the Japan Patent Office, the entire disclosure of which is incorporated herein by reference.

BACKGROUND

The present disclosure relates to a technique for shaping a double pipe.

There has been a technique for forming a bent portion in a double pipe by bending as disclosed, for example, in Japanese Patent No. 3983211.

SUMMARY

In some cases when using this type of technique, an outer pipe and an inner pipe have different curvatures as a result of bending, and a bent portion does not have a desired cross-sectional shape. Specifically, in some cases, a position of the inner pipe relative to the outer pipe is biased in the bent portion depending on conditions of bending.

In one aspect of the present disclosure, it is desirable to provide a technique for making a double pipe close to a desired shape.

One aspect of the present disclosure is a shaping method for a double pipe. The method comprises the following steps (i) and (ii):

(i) Bending the double pipe with a specified curvature to form a bent portion in the double pipe; and (ii) Arranging the bent portion on a first shaping die that comprises a first shaping surface at a position biased inward or outward in a curvature radius direction of the bent portion relative to the first shaping surface, and pressing the bent portion arranged on the first shaping die by a second shaping die that comprises a second shaping surface.

The first shaping surface is a shaping surface configured to shape a first outer surface of both outer surfaces of the bent portion that are located on both sides of a plane including a central axis of the bent portion. The second shaping surface is a shaping surface configured to shape a second outer surface of the both outer surfaces of the bent portion that are located on the both sides of the plane including the central axis of the bent portion.

With this configuration, when the bent portion arranged on the first shaping die is pressed by the second shaping die, a portion of an outer pipe forming the bent portion is expanded in the curvature radius direction of the bent portion. Accordingly, it is possible to make the outer pipe have a shape approximated to a desired shape by adjusting a cross-sectional shape of the bent portion depending on unevenness of the distance between an inner pipe and an outer pipe.

In one aspect of the present disclosure, the bent portion may be arranged on the first shaping die at a position biased outward in the curvature radius direction of the bent portion relative to the first shaping surface.

As a result of bending, the distance between the inner pipe and the outer pipe in the bent portion tends to be reduced inward in the curvature radius direction of the bent portion. With the above-described configuration, by arranging the bent portion at the position biased outward in the curvature radius direction of the bent portion relative to the first shaping surface and pressing the bent portion, the portion of the outer pipe forming the bent portion is expanded inward in the curvature radius direction of the bent portion. In other words, on a side of the bent portion with a narrower distance between the inner pipe and the outer pipe, the distance is widened. Accordingly, it is possible to make the double pipe have a shape approximated a desired shape.

In one aspect of the present disclosure, in the first shaping die, an outward portion of the first shaping surface in the curvature radius direction of the bent portion may have a height greater than a height of an inward portion of the first shaping surface.

With this configuration, even if the bent portion is arranged at a position biased outward in the curvature radius direction of the bent portion relative to the first shaping surface, it is possible to reduce expansion of the portion of the outer pipe forming the bent portion outward in the curvature radius direction of the bent portion by being pressed by the second shaping die.

In one aspect of the present disclosure, the bent portion may be arranged on the first shaping die by using a positioning member configured to position the bent portion relative to the first shaping surface.

With this configuration, it is possible to arrange the bent portion more accurately at a specified position of the first shaping die than in a case where the bent portion is positioned by a human relative to the first shaping surface.

One aspect of the present disclosure is a shaping device for a double pipe. The shaping device comprises a first shaping die and a second shaping die. The first shaping die comprises a first shaping surface. The first shaping surface is a shaping surface configured to shape a first outer surface of both outer surfaces of a bent portion formed in the double pipe, in which the both outer surfaces are located on both sides of a plane including a central axis of the bent portion. The second shaping die comprises a second shaping surface. The second shaping surface is a shaping surface configured to shape a second outer surface of the both outer surfaces of the bent portion formed in the double pipe, in which the both outer surfaces are located on the both sides of the plane including the central axis of the bent portion. The second shaping die is configured to press the bent portion arranged on the first shaping die at a position biased inward or outward in a curvature radius direction of the bent portion relative to the first shaping surface.

With this configuration, when the bent portion arranged on the first shaping die is pressed by the second shaping die, a portion of an outer pipe forming the bent portion is expanded in the curvature radius direction of the bent portion. Accordingly, it is possible to make the outer pipe have a shape approximated to a desired shape by adjusting a cross-sectional shape of the bent portion depending on unevenness of the distance between an inner pipe and an outer pipe.

BRIEF DESCRIPTION OF THE DRAWINGS

Example embodiments of the present disclosure will be described hereinafter with reference to the accompanying drawings, in which.

DETAILED DESCRIPTION OF EXEMPLARY EMBODIMENTS

1. Shaping Device

[1-1. Bending Device]

Figure 1:
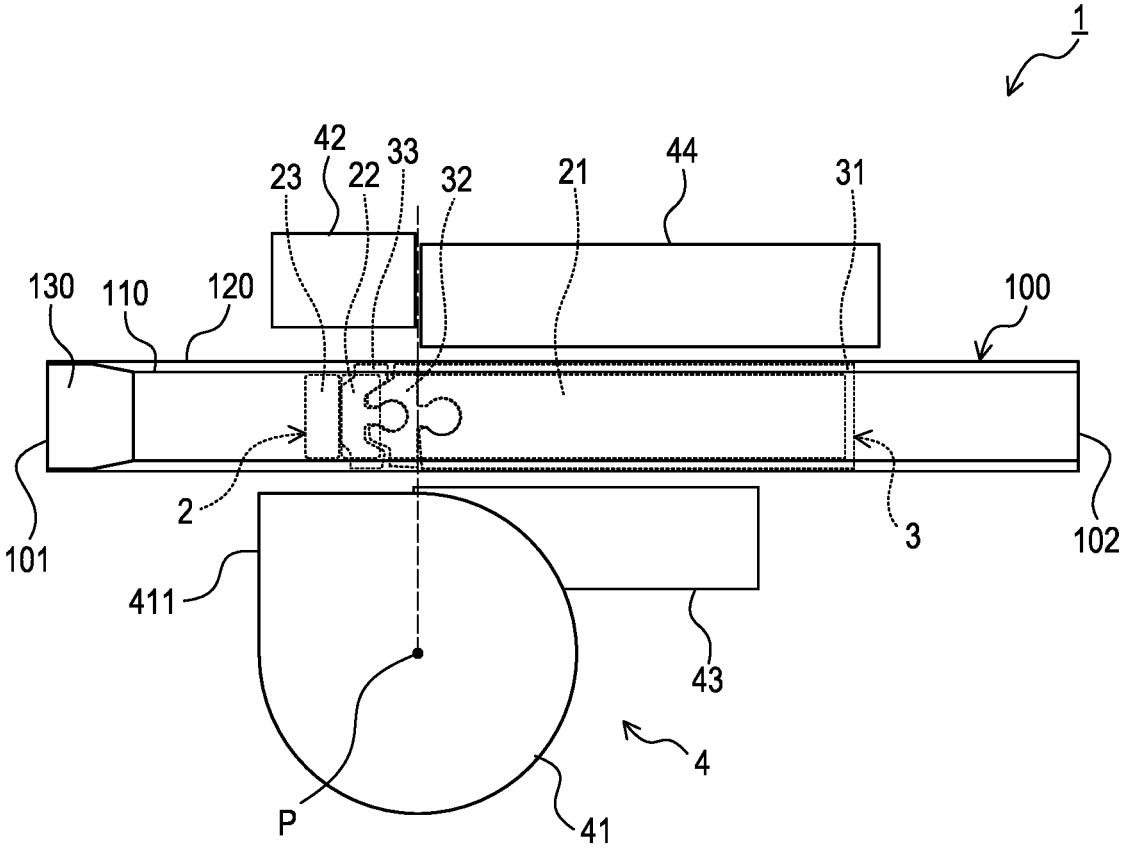
FIG. 1 is a schematic diagram showing a bending device.

A bending device 1 shown in FIG. 1 is a device for shaping a straight pipe into a bent pipe. In the present embodiment, a shaping target of the bending device 1 is a double pipe 100. The double pipe 100 is made of metal. The double pipe 100 comprises an inner pipe 110 and an outer pipe 120 arranged to cover an outer surface of the inner pipe 110. In other words, the inner pipe 110 is arranged inside the outer pipe 120. It is to be noted that the double pipe 100 is shown in a sectional view in all figures except FIG. 5.

The double pipe 100 comprises a joining portion 130 between the inner pipe 110 and the outer pipe 120. The joining portion 130 is provided at a first end 101, which is one end, in an axial direction, of the double pipe 100. Specifically, a portion of the inner pipe 110 forming the first end 101 of the double pipe 100 is expanded in diameter so as to contact an inner surface of the outer pipe 120, and is joined to the inner surface of the outer pipe 120 by welding or the like. The inner pipe 110 and the outer pipe 120 are not joined together at a second end 102, which is an opposite end to the first end 101 in the axial direction of the double pipe 100.

The inner pipe 110 and the outer pipe 120 each have a circular shape (specifically, a perfect circle or an ellipse) in a cross-section orthogonal to a central axis thereof. In one example, the inner pipe 110 and the outer pipe 120 before bending by the bending device 1 each have a perfect circular shape in the cross-section orthogonal to the central axis thereof. Before bending, the outer pipe 120 has a constant diameter along its axial direction. Before bending, the inner pipe 110 also has a constant diameter along its axial direction except for a portion forming the joining portion 130. In the double pipe 100 before bending, a central axis of the inner pipe 110 and a central axis of the outer pipe 120 coincide with each other. Thus, in the double pipe 100 before bending, a distance between the inner pipe 110 and the outer pipe 120 is equal along a circumferential direction of the double pipe 100.

Figure 6A:
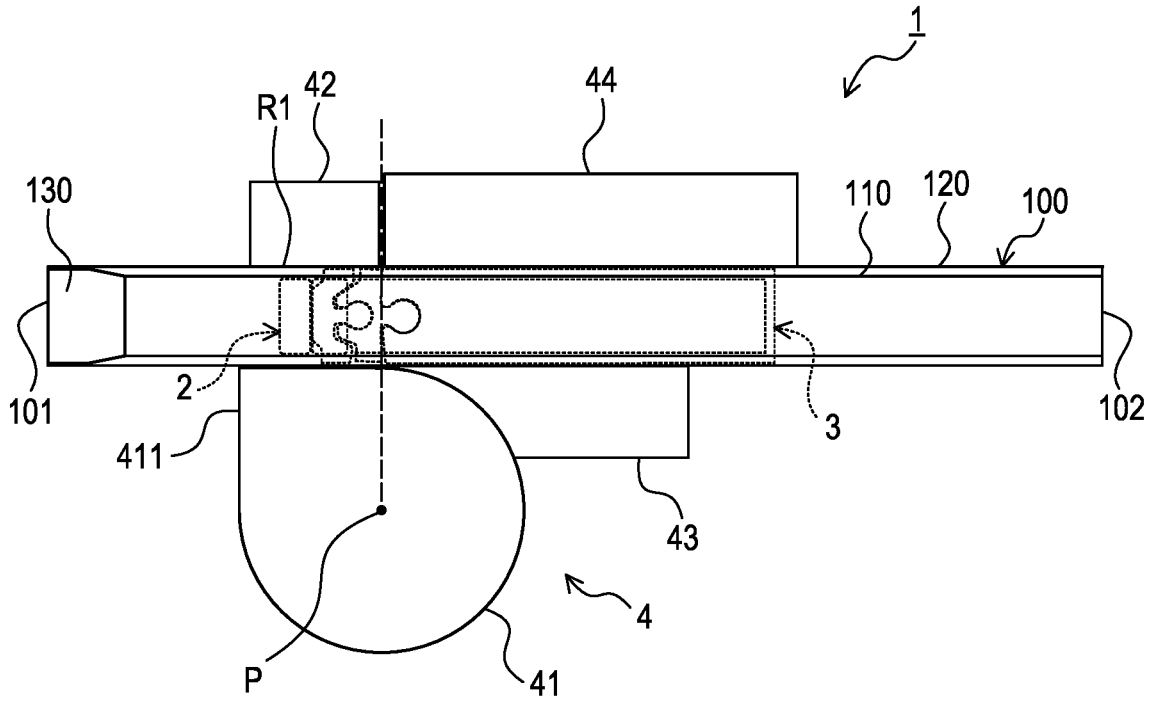
FIG. 6A is a schematic diagram illustrating a first bending process.
Figure 6B:
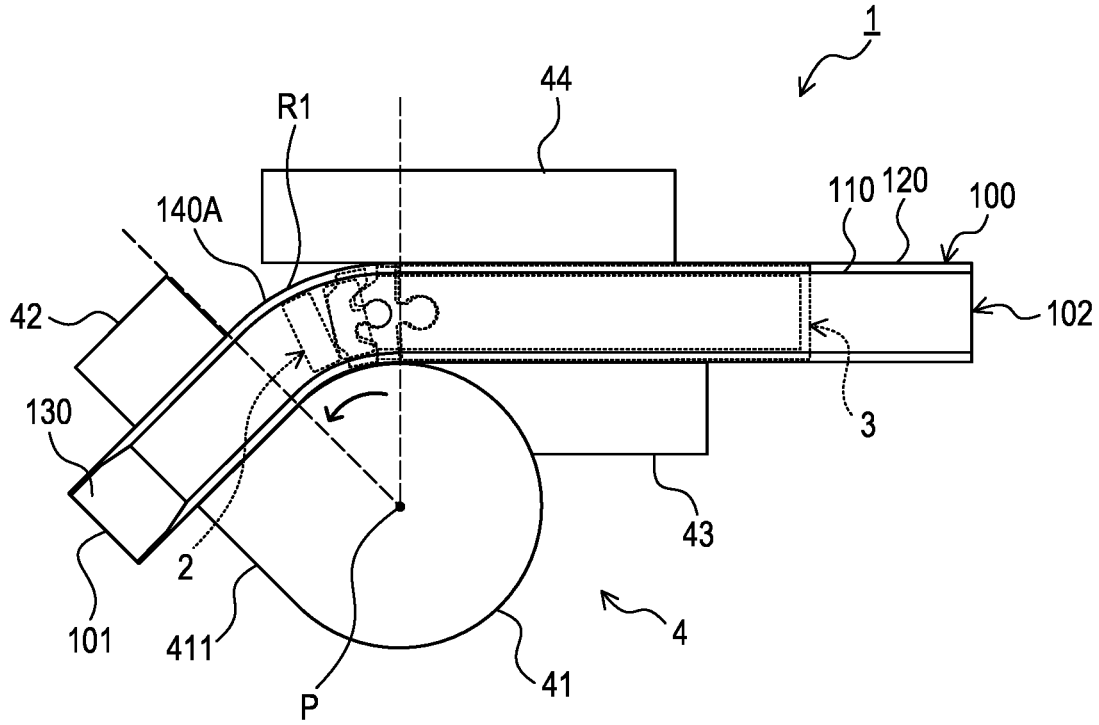
FIG. 6B is a schematic diagram illustrating a state subsequent to FIG. 6A in the first bending process.

As shown in FIG. 6A and FIG. 6B, the bending device 1 bends the inner pipe 110 and the outer pipe 120 simultaneously, thereby to obtain the double pipe 100 with a partially curved central axis as a bent pipe. Specifically, the bending device 1 forms a bent portion 140 in the double pipe 100 by bending. In the bent portion 140, the central axis is curved. In one example, two bent portions 140 are formed in the double pipe 100 by bending. In the description hereinafter and the drawings, the two bent portions 140 are also represented by a first bent portion 140A and a second bent portion 140B for distinction purposes.

On both sides of the bent portion 140 in the double pipe 100 after bending, the central axis remains straight without being bent by the bending device 1. A portion of the double pipe 100 that is not bent by the bending device 1, i.e., a portion of the double pipe 100 in which the bent portion 140 is not formed, is hereinafter referred to as a "straight portion".

The bending device 1 comprises an inner mandrel 2, an intermediate mandrel 3, and a bending die 4.

Figure 2:
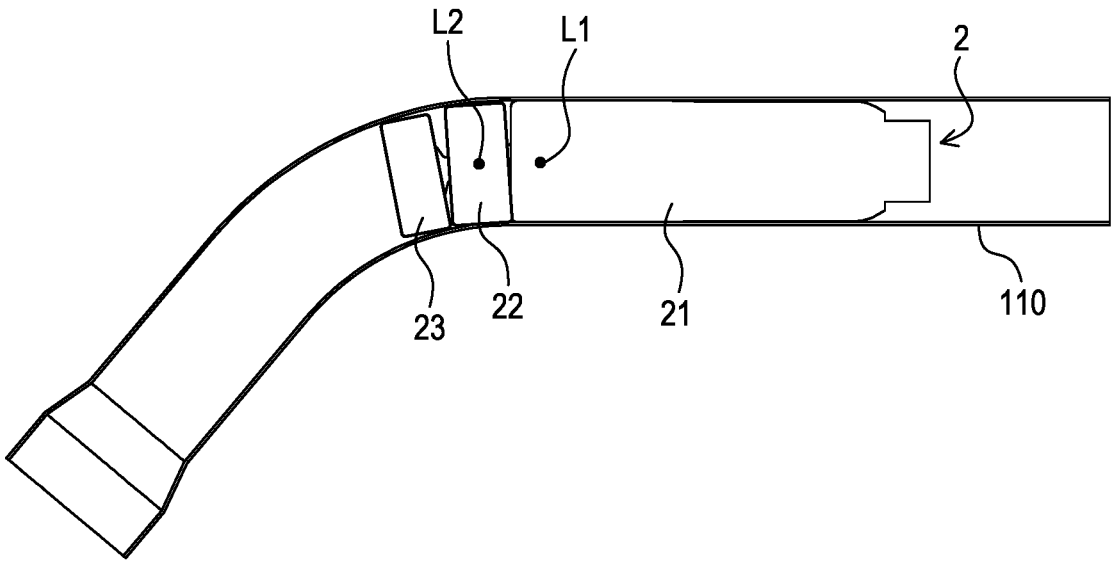
FIG. 2 is a schematic diagram showing an inner mandrel in the bending device.

As shown in FIG. 2, the inner mandrel 2 is configured to be arranged inside the inner pipe 110. The inner mandrel 2 comprises an inner mandrel main body 21, a first inner movable portion 22, and a second inner movable portion 23.

The inner mandrel main body 21 is a cylindrical or columnar member. The inner mandrel main body 21 is arranged in the straight portion of the double pipe 100. The inner mandrel main body 21 has a constant outer diameter along its axial direction. The outer diameter of the inner mandrel main body 21 is substantially equal to an inner diameter of the inner pipe 110 before bending.

The first inner movable portion 22 is a cylindrical or columnar member that is coupled to one end in the axial direction of the inner mandrel main body 21. The first inner movable portion 22 pivots, relative to the inner mandrel main body 21, about a first pivot axis L1 that is perpendicular to a central axis of the inner mandrel main body 21. The first pivot axis L1 passes through an intersection point between a straight line including the central axis of the inner mandrel main body 21 and a straight line including a central axis of the first inner movable portion 22. The first inner movable portion 22 has a length along its axial direction that is shorter than a length of the inner mandrel main body 21 along its axial direction.

The second inner movable portion 23 is a cylindrical or columnar member that is coupled to the first inner movable portion 22 on an opposite side to the inner mandrel main body 21. The second inner movable portion 23 pivots, relative to the first inner movable portion 22, about a second pivot axis L2 that is parallel to the first pivot axis L1 of the first inner movable portion 22. The second pivot axis L2 passes through an intersection point between a straight line including the central axis of the first inner movable portion 22 and a straight line including a central axis of the second inner movable portion 23. The second inner movable portion 23 also has a length along its axial direction that is shorter than the length of the inner mandrel main body 21 along its axial direction.

Figure 3:
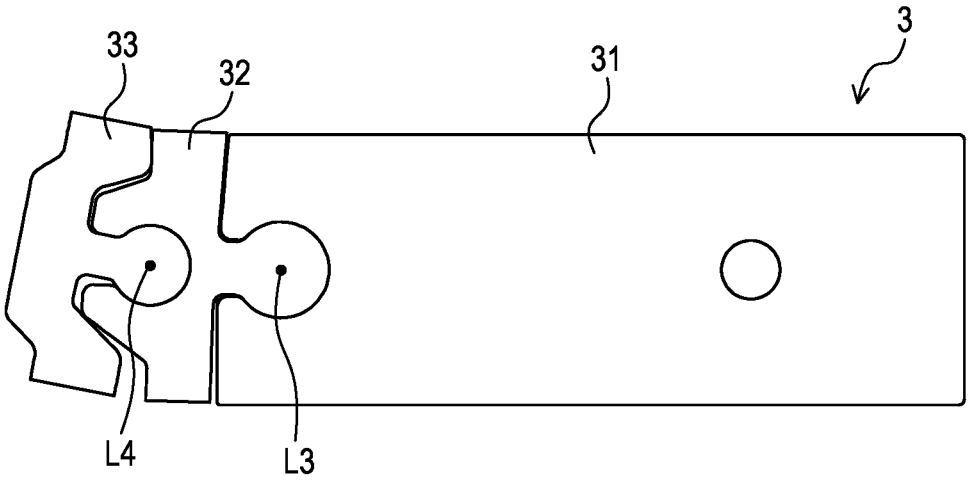
FIG. 3 is a schematic diagram showing an intermediate mandrel in the bending device.

The intermediate mandrel 3 shown in FIG. 3 is configured to be arranged between the inner pipe 110 and the outer pipe 120. The intermediate mandrel 3 is arranged in a portion of the double pipe 100 where the bent portion 140 is to be formed (i.e., a portion of the double pipe 100 to be bent by the bending device 1) so as to radially hold the inner pipe 110 together with the inner mandrel 2. Also, the intermediate mandrel 3 is held by the inner pipe 110 and the outer pipe 120 along a radial direction of the inner pipe 110. The intermediate mandrel 3 comprises an intermediate mandrel main body 31, a first intermediate movable portion 32, and a second intermediate movable portion 33.

The intermediate mandrel main body 31 is a cylindrical member. The intermediate mandrel main body 31 is arranged in the straight portion of the double pipe 100. The intermediate mandrel main body 31 has a constant inner diameter and a constant outer diameter along its axial direction. The inner diameter of the intermediate mandrel main body 31 is substantially equal to an outer diameter of the inner pipe 110 before bending. The outer diameter of the intermediate mandrel main body 31 is substantially equal to an inner diameter of the outer pipe 120 before bending.

The first intermediate movable portion 32 is a cylindrical member that is coupled to one end in the axial direction of the intermediate mandrel main body 31. The first intermediate movable portion 32 pivots, relative to the intermediate mandrel main body 31, about a third pivot axis L3 that is perpendicular to a central axis of the intermediate mandrel main body 31. The third pivot axis L3 passes through an intersection point between a straight line including the central axis of the intermediate mandrel main body 31 and a straight line including a central axis of the first intermediate movable portion 32. The third pivot axis L3 is parallel to the first pivot axis L1. The first intermediate movable portion 32 has a length along its axial direction shorter than a length of the intermediate mandrel main body 31 along its axial direction.

The second intermediate movable portion 33 is a cylindrical member that is coupled to the first intermediate movable portion 32 on an opposite side to the intermediate mandrel main body 31. The second intermediate movable portion 33 pivots, relative to the first intermediate movable portion 32, about a fourth pivot axis L4 that is parallel to the third pivot axis L3 of the first intermediate movable portion 32. The fourth pivot axis L4 passes through an intersection point between a straight line including the central axis of the first intermediate movable portion 32 and a straight line including a central axis of the second intermediate movable portion 33. The second intermediate movable portion 33 has a length along its axial direction shorter than the length of the intermediate mandrel main body 31 along its axial direction.

Returning to FIG. 1, the bending die 4 is configured to bend the double pipe 100 in an area where the inner mandrel 2 and the intermediate mandrel 3 are arranged. Specifically, the bending die 4 rotates and moves while radially holding the inner pipe 110 and the outer pipe 120 together with the inner mandrel 2 and the intermediate mandrel 3, thereby to bend the inner pipe 110 and the outer pipe 120. The bending die 4 comprises a rotating portion 41, a pivot clamp portion 42, a slider 43, and a feeder 44.

The rotating portion 41 is arranged to radially overlap the portion of the double pipe 100 where the bent portion 140 is to be formed. The rotating portion 41 is configured to rotate about a rotation axis P with a chuck portion 411 pressed against an outer surface of the double pipe 100. The rotation axis P of the rotating portion 41 is parallel to the first pivot axis L1 of the first inner movable portion 22.

The pivot clamp portion 42 is arranged opposite to the rotating portion 41 with the double pipe 100 located therebetween. The pivot clamp portion 42 is configured to hold the double pipe 100 together with the chuck portion 411 of the rotating portion 41. The pivot clamp portion 42 pivots about the rotation axis P of the rotating portion 41 in accordance with rotation of the rotating portion 41.

The slider 43 is arranged adjacent to the rotating portion 41. The slider 43 slides on an outer surface of the straight portion of the double pipe 100 during bending, to thereby serve a guiding function to feed the double pipe 100 along a rotation direction of the rotating portion 41.

The feeder 44 is arranged in a position opposite to the slider 43 across the double pipe 100 and adjacent to the pivot clamp portion 42. The feeder 44 is configured to move along a central axis of the straight portion of the double pipe 100 while pressing the straight portion. The feeder 44 feeds the double pipe 100 toward the rotating portion 41 while pressing the double pipe 100 against the slider 43.

As shown in FIG. 6A and FIG. 6B, the chuck portion 411 of the rotating portion 41 and the pivot clamp portion 42 that are holding the double pipe 100 therebetween slide on the outer surface of the double pipe 100, which is a straight pipe, about the rotation axis P toward the first end 101, and thereby the double pipe 100 is bent about the rotation axis P of the rotating portion 41. As a result, the double pipe 100 with the bent portion 140 is obtained as a bent pipe.

Figure 8A:
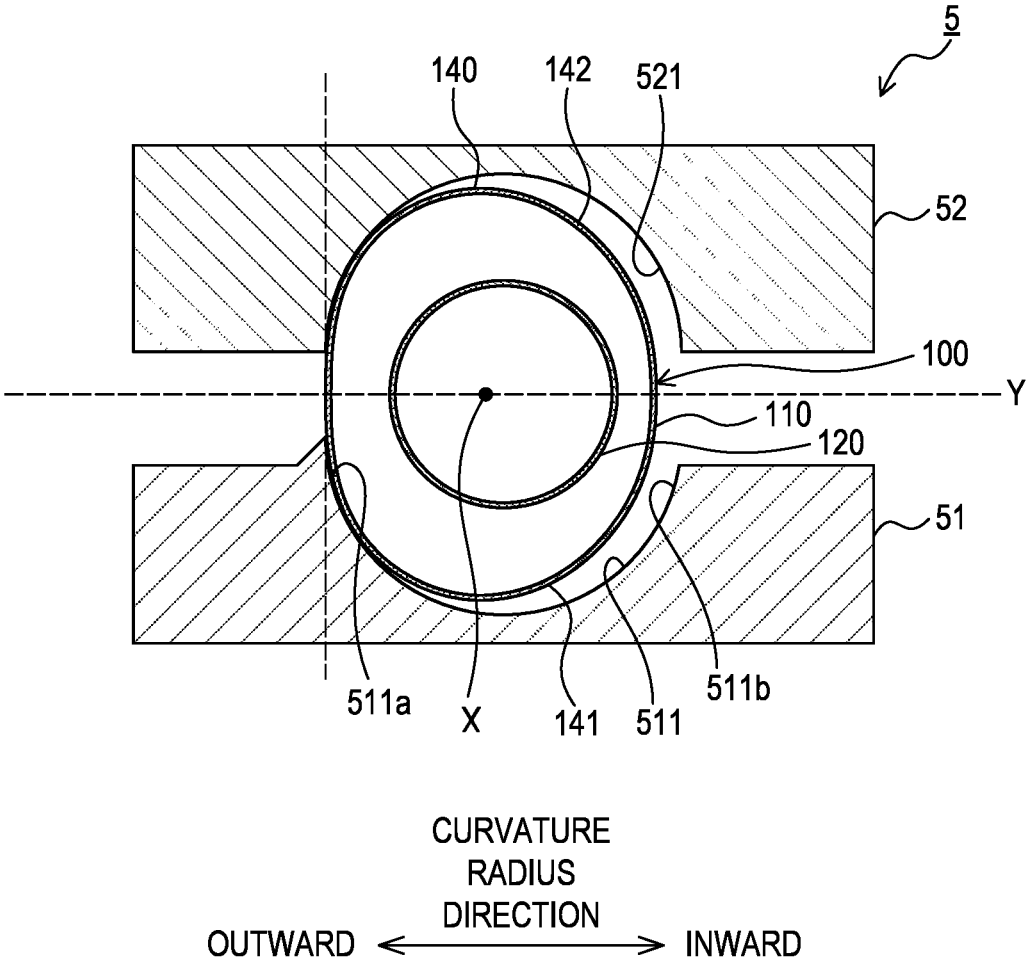
FIG. 8A is a schematic diagram illustrating a bent portion shaping process.

Details of the bending will be described later. In the double pipe 100 after the bending, a portion of the outer pipe 120 forming the bent portion 140 is made flatter as shown in FIG. 8A as a result of being held and bent by the chuck portion 411 of the rotating portion 41 and the pivot clamp portion 42. As used herein, flattening of the outer pipe 120 by the bending means that the shape of the outer pipe 120 in a cross section perpendicular to its axial direction is deformed as compared with that before the bending. Specifically, the shape in a cross section of the portion of the outer pipe 120 forming the bent portion 140 after the bending is an irregular circle that is extended along a direction of the rotation axis P (specifically, that is distorted in a curvature radius direction of the bent portion 140). Also, the bent portion 140 has different curvatures along a circumferential direction of the outer pipe 120 between outward and inward in the curvature radius direction of the bent portion 140.

During the bending, the outer pipe 120 is bent by a direct action of the chuck portion 411 of the rotating portion 41 and the pivot clamp portion 42, while the inner pipe 110 is bent since the portion forming the joining portion 130 is dragged in accordance with displacement of the outer pipe 120. Thus, the inner pipe 110 and the outer pipe 120 do not always have the same curvature as a result of bending, and the outer pipe 120 is more likely to have a larger curvature than the inner pipe 110. When the inner pipe 110 and the outer pipe 120 have different curvatures, the central axis of the inner pipe 110 and the central axis of the outer pipe 120 do not coincide with each other, resulting in an uneven distance between the inner pipe 110 and the outer pipe 120 along the circumferential direction of the double pipe 100.

[1-2. Bent Portion Shaping Device]

Figure 4:
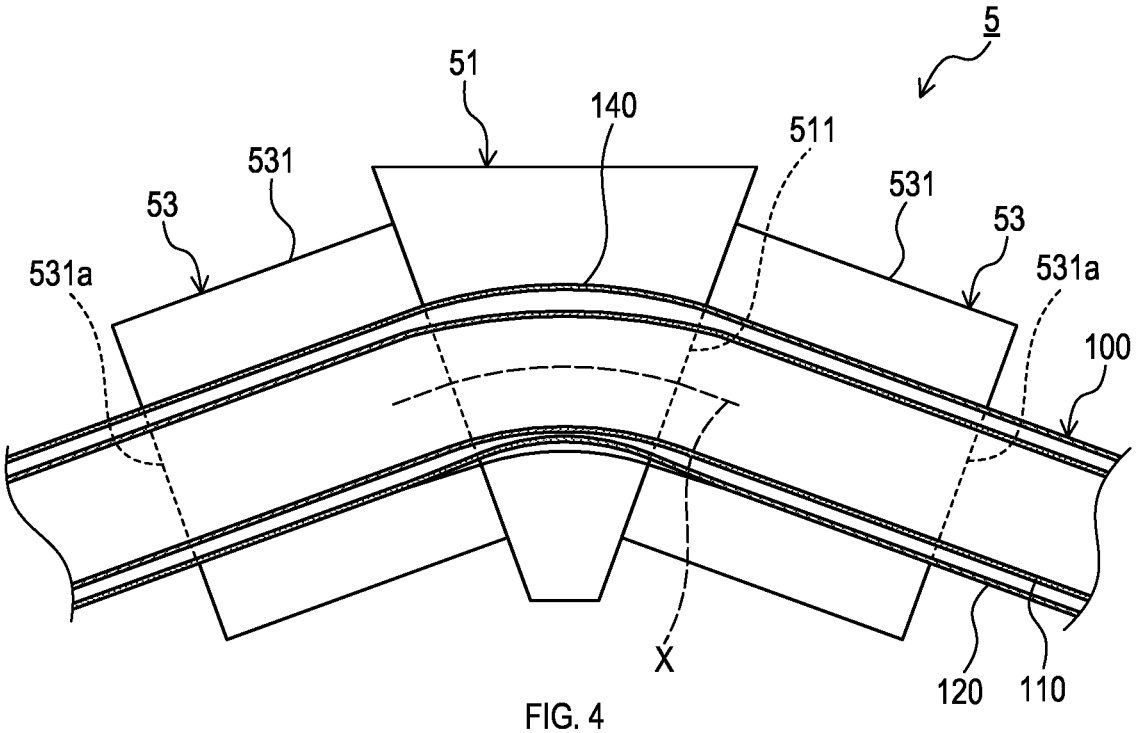
FIG. 4 is a top view schematically showing a bent portion shaping device.
Figure 5:
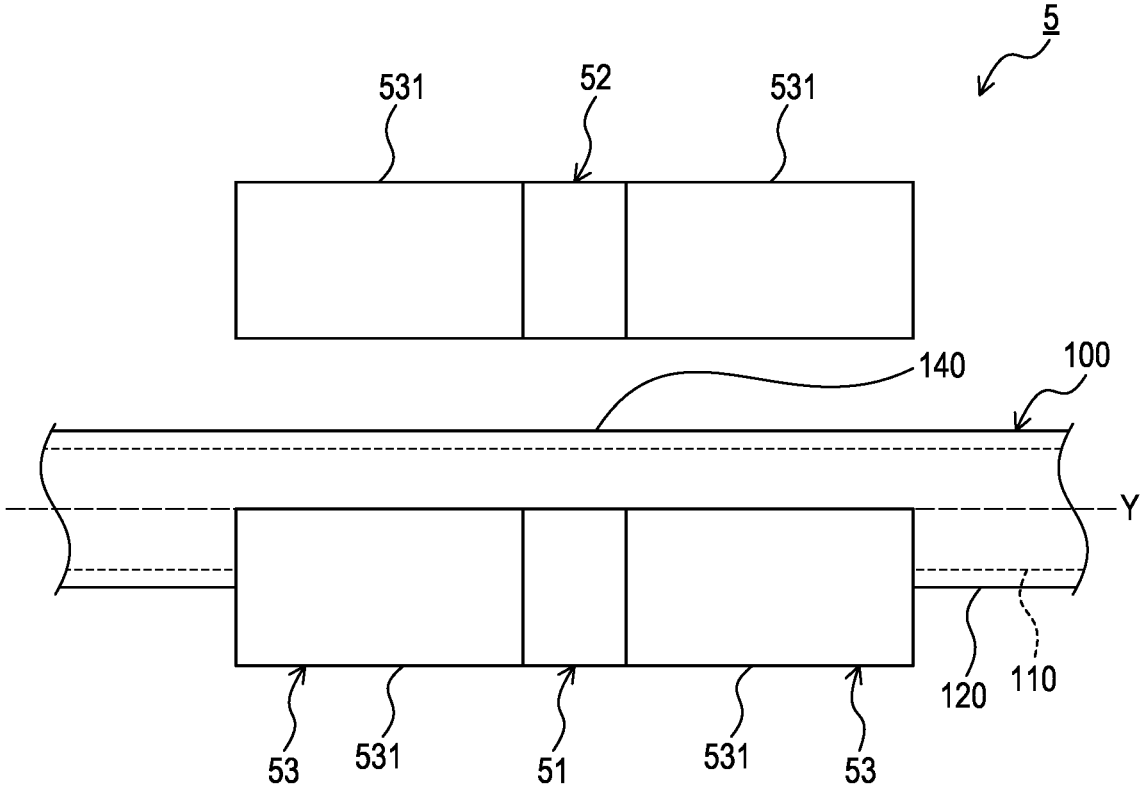
FIG. 5 is a side view schematically showing the bent portion shaping device.

A bent portion shaping device 5 shown in FIG. 4 and FIG. 5 is a device for shaping the double pipe 100 after the bending by the bending device 1. As described above, due to the bending, the portion of the outer pipe 120 forming the bent portion 140 is distorted in the curvature radius direction of the bent portion 140 and the position of the inner pipe 110 relative to the outer pipe 120 is biased in the double pipe 100. Thus, the bent portion shaping device 5 is configured to shape the portion of the outer pipe 120 forming the bent portion 140 such that the double pipe 100 after the bending has a shape approximated to a desired shape as a finished product.

The bent portion shaping device 5 comprises a first shaping die 51, a second shaping die 52, and two positioning members 53. In FIG. 4, the second shaping die 52 is not shown. Also, although the positioning members 53 each have two clamp portions 531 capable of radially holding the double pipe 100 as described later, the clamp portions 531 on the second shaping die 52 are not shown in FIG. 4.

A plane including a central axis X of the bent portion 140 is referred to as a "center plane Y". Since the central axis X of the bent portion 140 is curved, the center plane Y is unambiguously determined. The center plane Y is perpendicular to the rotation axis P of the rotating portion 41 during the bending by the bending device 1.

The first shaping die 51 and the second shaping die 52 are shaping dies to shape the portion of the outer pipe 120 forming the bent portion 140. The first shaping die 51 and the second shaping die 52 are arranged on one side and the other side of the center plane Y so as to hold the bent portion 140 therebetween. The second shaping die 52 is displaceable so as to approach and separate from the first shaping die 51. An approaching/separating direction between the first shaping die 51 and the second shaping die 52 (i.e., a displacement direction of the second shaping die 52) is a direction along the rotation axis P of the rotating portion 41 during the bending by the bending device 1.

Figure 8B:
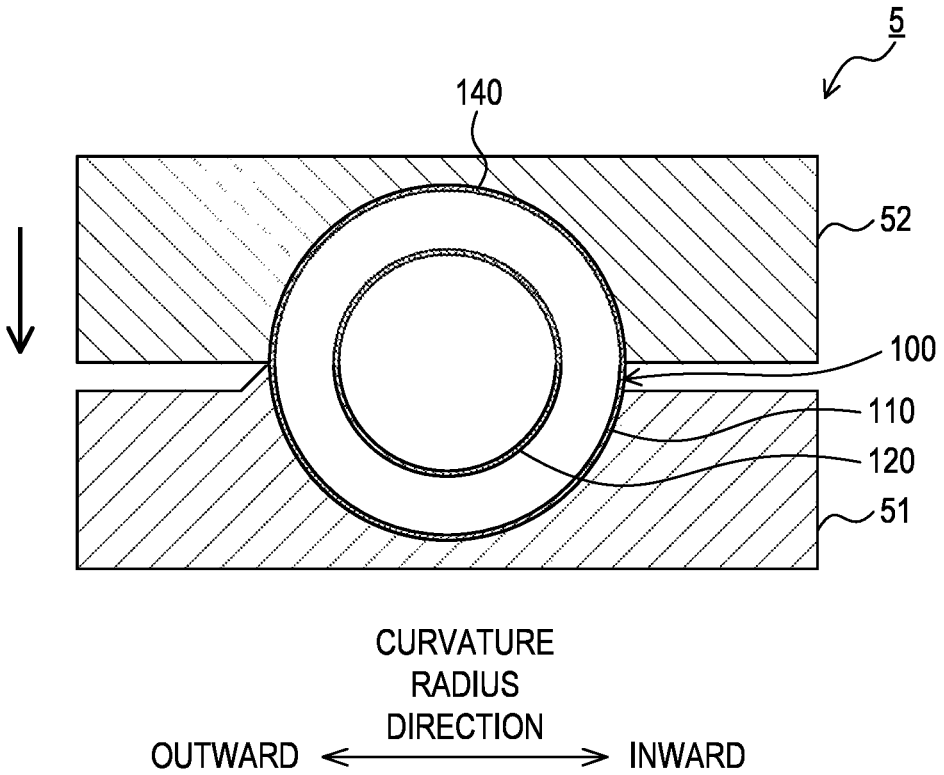
FIG. 8B is a schematic diagram illustrating a state subsequent to FIG. 8A in the bent portion shaping process.

FIG. 8A and FIG. 8B are each a schematic diagram of a cross section perpendicular to the central axis X of the bent portion 140. As shown in FIG. 8A, the first shaping die 51 comprises a first shaping surface 511 to shape a first outer surface 141 of the bent portion 140. The first outer surface 141 of the bent portion 140 means one outer surface of both outer surfaces of the bent portion 140 located on both sides of the center plane Y. The first shaping surface 511 has a groove shape. The first shaping surface 511 is formed to have a curved shape so as to correspond to the first outer surface 141 of the bent portion 140 that is designed as a finished product. The first shaping surface 511 has, for example, an arcuate cross section that is perpendicular to an extending direction of the first shaping surface 511. As shown in FIG. 4, the extending direction of the first shaping surface 511 is curved in accordance with a curvature of the bent portion 140 that is designed as a finished product.

As shown in FIG. 8A, an outside surface 511*a*, which is an outward portion of the first shaping surface 511 in the curvature radius direction of the bent portion 140, has a height greater than a height of an inside surface 511*b*, which is an inward portion of the first shaping surface 511 in the curvature radius direction of the bent portion 140. The height of the first shaping surface 511 specifically means a height of the first shaping surface 511 along the approaching/separating direction of the first shaping die 51 and the second shaping die 52. As one example, a portion forming the outside surface 511*a* of the first shaping die 51 has an angular cross section (specifically, a triangular cross section having a corner directed in a height direction of the first shaping surface 511). That is, the first shaping die 51 comprises a ridge portion forming a part of the outside surface 511*a*.

The second shaping die 52 comprises a second shaping surface 521 configured to shape a second outer surface 142 of the bent portion 140. The second outer surface 142 of the bent portion 140 means an outer surface opposite to the first outer surface 141 of the both outer surfaces of the bent portion 140 located on both sides of the center plane Y. The second shaping surface 521 has basically the same configuration as the first shaping surface 511. Specifically, the second shaping surface 521 also has a groove shape, and is formed to have a curved shape so as to correspond to the second outer surface 142 of the bent portion 140 that is designed as a finished product. The second shaping surface 521 has, for example, an arcuate cross section that is perpendicular to an extending direction of the second shaping surface 521. The extending direction of the second shaping surface 521 is curved in accordance with the curvature of the bent portion 140 that is designed as a finished product. However, an outward portion and an inward portion of the second shaping surface 521 in the curvature radius direction of the bent portion 140 have an equal height. The height of the second shaping surface 521 specifically means a height of the second shaping surface 521 along the approaching/separating direction of the first shaping die 51 and the second shaping die 52.

Returning to FIG. 4, two positioning members 53 are configured to position the bent portion 140 relative to the first shaping surface 511 of the first shaping die 51. The two positioning members 53 are arranged on both sides of the first shaping die 51 along the extending direction of the first shaping surface 511, to secure the respective straight portions on both sides of the bent portion 140 of the double pipe 100.

Specifically, as shown in FIG. 5, the positioning members 53 each comprise two clamp portions 531. The two clamp portions 531 are arranged on one side and the other side across the center plane Y. The clamp portion 531 arranged on a same side as the second shaping die 52 is configured to be displaceable to approach and separate from the clamp portion 531 arranged on a same side as the first shaping die 51. An approaching/separating direction of the clamp portions 531 is parallel to the approaching/separating direction of the first shaping die 51 and the second shaping die 52.

The clamp portions 531 each comprise a groove 531*a* allowing arrangement of the straight portion of the double pipe 100 therein. In a state where the two clamp portions 531 are arranged on both sides of the center plane Y, the grooves 531*a* face each other. When the clamp portions 531 approach each other, the straight portion of the double pipe 100 is held by the respective grooves 531*a*. As a result, the straight portion of the double pipe 100 is secured.

As described above, the portion of the outer pipe 120 forming the bent portion 140 is made flatter by the bending as shown in FIG. 8A, and the portion has a cross-sectional shape of an irregular circle that is distorted in the curvature radius direction of the bent portion 140. A length of the bent portion 140 along the curvature radius direction is shorter than a width of the first shaping surface 511. Thus, when the bent portion 140 is arranged on the first shaping surface 511, the bent portion 140 is partially separated from the first shaping surface 511.

In a case where the two positioning members 53 are used when arranging the bent portion 140 on the first shaping surface 511 (i.e., when the straight portions of the double pipe 100 on both sides of the bent portion 140 are secured by the two positioning members 53), the bent portion 140 is located at a position biased outward in the curvature radius direction of the bent portion 140 relative to the first shaping surface 511 of the first shaping die 51. In other words, the bent portion 140 is arranged at a position where a distance from the outward portion of the first shaping surface 511 of the first shaping die 51 in the curvature radius direction of the bent portion 140 is smaller than a distance from the inward portion of the first shaping surface 511. In one example, the bent portion 140 is arranged at a position contacting the outward portion of the first shaping surface 511 in the curvature radius direction of the bent portion 140 and separating from the inward portion of the first shaping surface 511.

2. Shaping Method

Next, a description will be given of a shaping method of the double pipe 100 using the bending device 1 and the bent portion shaping device 5. The shaping method comprises a first bending process, a second bending process, and a bent portion shaping process.

[2-1. First Bending Process]

The first bending process is a process to form a first bent portion 140A in a first area R1 of the double pipe 100, which is a straight pipe.

First, as shown in FIG. 1, in the double pipe 100 as a straight pipe, the inner mandrel 2 is placed inside the inner pipe 110, and the intermediate mandrel 3 is placed between the inner pipe 110 and the outer pipe 120. Specifically, relative to the inner mandrel 2 and the intermediate mandrel 3 held between the rotating portion 41 and the pivot clamp portion 42 of the bending die 4, the double pipe 100 is axially inserted from the second end 102. In this case, the inner mandrel 2 is held such that respective central axes of the inner mandrel main body 21, the first inner movable portion 22, and the second inner movable portion 23 are on a same straight line. Similarly, the intermediate mandrel 3 is held such that respective central axes of the intermediate mandrel main body 31, the first intermediate movable portion 32, and the second intermediate movable portion 33 are on a same straight line. Also, the first inner movable portion 22 is placed so as to at least partially overlap the intermediate mandrel 3 in the radial direction of the inner pipe 110. The second inner movable portion 23 is placed so as not to overlap the intermediate mandrel 3 in the radial direction of the inner pipe 110.

Then, as shown in FIG. 6A, the double pipe 100 with the inner mandrel 2 and the intermediate mandrel 3 placed therein is held by the bending die 4. Specifically, the double pipe 100 with the inner mandrel 2 and the intermediate mandrel 3 placed therein is radially pressurized by the pivot clamp portion 42 and the feeder 44. As a result, the double pipe 100 radially slides together with the inner mandrel 2 and the intermediate mandrel 3 toward the rotating portion 41 and the slider 43. Then, the double pipe 100 is pressed against the chuck portion 411 of the rotating portion 41 by the pivot clamp portion 42, and is pressed against the slider 43 by the feeder 44.

Subsequently, as shown in FIG. 6B, the first area R1 of the double pipe 100 with the inner mandrel 2 and the intermediate mandrel 3 placed therein is bent by the bending die 4. Specifically, while the rotating portion 41 is rotated in a direction such that the chuck portion 411 separates from the slider 43 (i.e., toward the first end 101 of the double pipe 100), the feeder 44 is caused to slide in a direction to follow the pivot clamp portion 42 that moves in accordance with the rotation of the rotating portion 41. As a result, the chuck portion 411 and the pivot clamp portion 42, while holding the double pipe 100, slide on the outer surface of the double pipe 100 toward the first end 101 about the rotation axis P of the rotating portion 41. Accordingly, a portion of the double pipe 100 held between the chuck portion 411 and the pivot clamp portion 42 is plastically deformed so as to be curved about the rotation axis P of the rotating portion 41.

In accordance with the bending of the double pipe 100 by the rotation of the rotating portion 41, the first inner movable portion 22 pivots relative to the inner mandrel main body 21. Also, the second inner movable portion 23 pivots relative to the first inner movable portion 22. Similarly, in accordance with the bending of the double pipe 100 by the rotation of the rotating portion 41, the first intermediate movable portion 32 pivots relative to the intermediate mandrel main body 31. Further, the second intermediate movable portion 33 pivots relative to the first intermediate movable portion 32. The inner mandrel main body 21 and the intermediate mandrel main body 31 are held so as not to move during the bending process. Accordingly, the double pipe 100 slides on the inner mandrel 2 and the intermediate mandrel 3, and moves in a moving direction of the pivot clamp portion 42 while being extended.

As a result of the bending of the double pipe 100, the first bent portion 140A is formed in the first area R1 of the double pipe 100. During the bending of the double pipe 100, the inner pipe 110 is axially pulled due to resistance of the inner mandrel 2 and the intermediate mandrel 3, and thus is bent to approach an inward portion of the outer pipe 120 in a curvature radius direction. Specifically, in the first bent portion 140A, the inner pipe 110 has a curvature smaller than a curvature of the outer pipe 120. Thus, a distance between the inner pipe 110 and the outer pipe 120 is reduced inward in a curvature radius direction of the first bent portion 140A.

As described above, during bending, the second inner movable portion 23 of the inner mandrel 2 is arranged so as not to overlap the intermediate mandrel 3 in the radial direction of the inner pipe 110. Thus, the first area R1 of the double pipe 100 includes a part in which the intermediate mandrel 3 is not located between the inner pipe 110 and the outer pipe 120, while the inner mandrel 2 is located inside the inner pipe 110, in the radial direction of the inner pipe 110. Thus, the cross-sectional shape of the outer pipe 120 is deformable in accordance with the bending. Specifically, a portion of the outer pipe 120 forming the first bent portion 140A has a shape of an irregular circle that is extended along the direction of the rotation axis P.

[2-2. Second Bending Process]

The second bending process is a process to form the second bent portion 140B in a second area R2, which is different from the first area R1, of the double pipe 100 in which the first bent portion 140A has been formed in the first bending process.

Figure 7A:
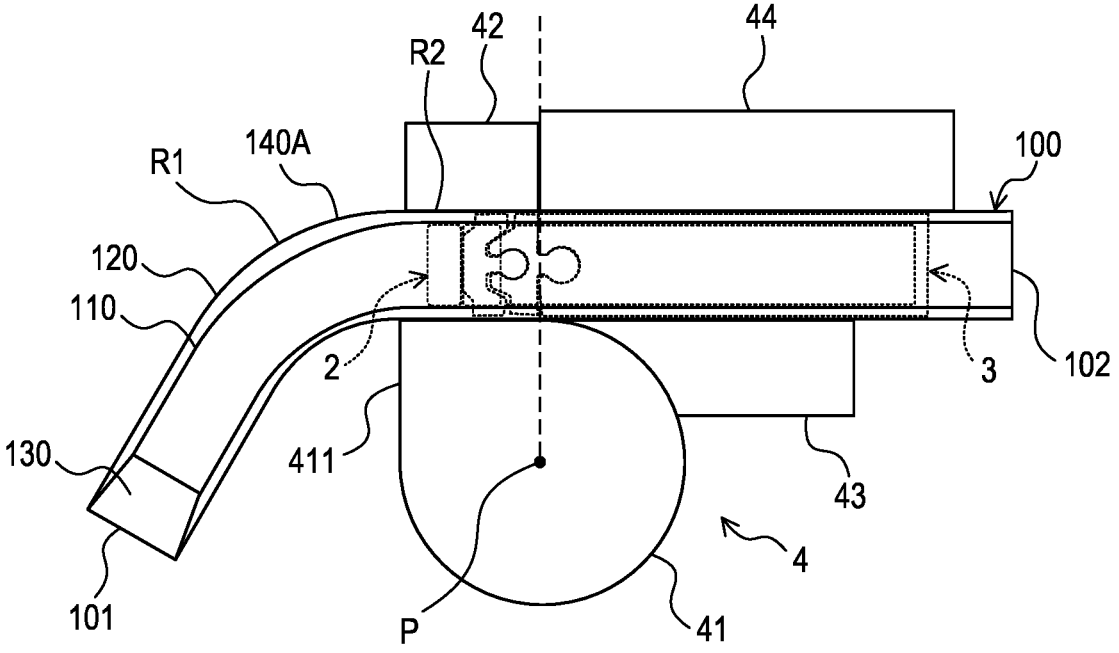
FIG. 7A is a schematic diagram illustrating a second bending process.

First, starting from a state after the first bending process shown in FIG. 6B, the inner mandrel 2 and the intermediate mandrel 3 are pulled back to a position overlapping the second area R2 as shown in FIG. 7A. The second area R2 is more distant from the joining portion 130 of the double pipe 100 than the first area R1 and is closer to the second end 102 of the double pipe 100 than the first area R1. As a result that the inner mandrel 2 and the intermediate mandrel 3 are pulled from the first area R1 toward the second area R2, the inner pipe 110 is axially extended and a curvature of the inner pipe 110 is reduced in the first area R1. Accordingly, the distance between the inner pipe 110 and the outer pipe 120 inward in the curvature radius direction of the first bent portion 140A becomes further smaller than immediately after the first bending process.

Subsequent to pulling the inner mandrel 2 and the intermediate mandrel 3, in the bending die 4 after the first bending process, the pivot clamp portion 42 and the feeder 44 are radially separated from the double pipe 100, and the double pipe 100 is separated from the rotating portion 41 and the slider 43. Also, the feeder 44 is returned to its initial position (specifically, a position before the bending).

As shown in FIG. 7A, after the rotating portion 41 and the pivot clamp portion 42 are returned to their initial positions, the double pipe 100 is axially slid together with the inner mandrel 2 and the intermediate mandrel 3 to a position where the second area R2 of the double pipe 100 radially overlaps the pivot clamp portion 42. Then, the double pipe 100 with the inner mandrel 2 and the intermediate mandrel 3 placed therein is radially pressurized by the pivot clamp portion 42 and the feeder 44, and thereby the double pipe 100 is held by the bending die 4.

Figure 7B:
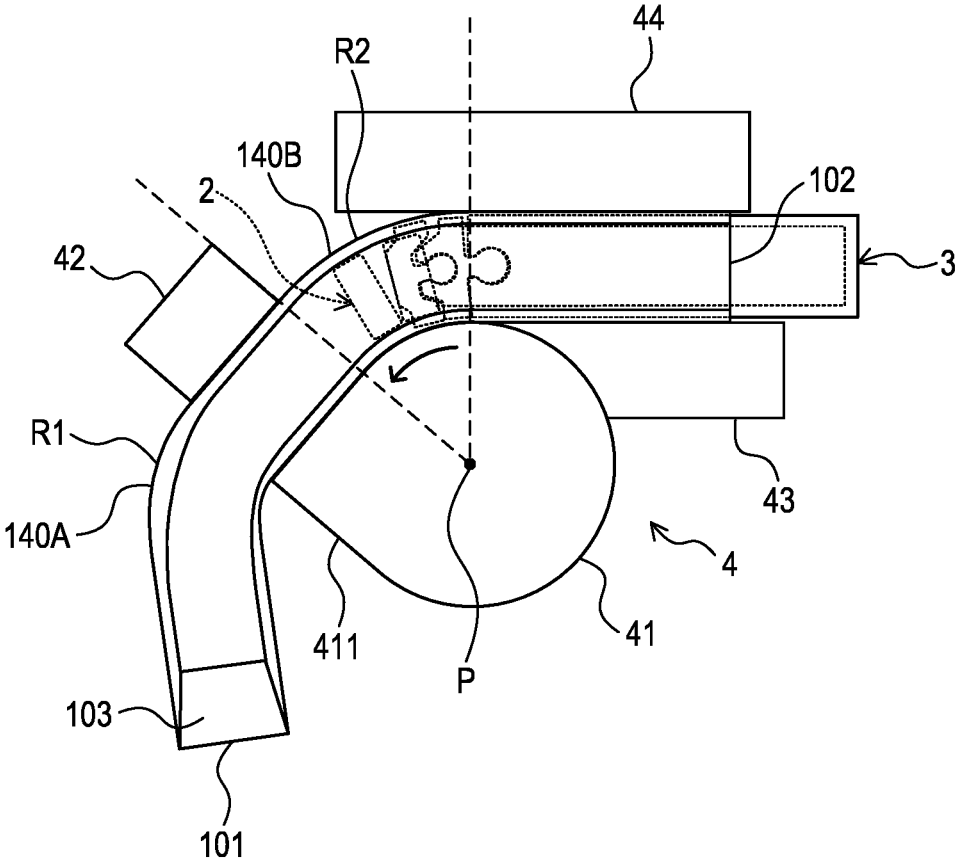
FIG. 7B is a schematic diagram illustrating a state subsequent to FIG. 7A in the second bending process.

Subsequently, the second area R2 of the double pipe 100 with the inner mandrel 2 and the intermediate mandrel 3 placed therein is bent by the bending die 4. A specific method is the same as that for the bending of the first area R1 of the double pipe 100 in the first bending process. Specifically, as shown in FIG. 7B, the rotating portion 41 is rotated in a direction where the chuck portion 411 is separated from the slider 43, and the feeder 44 is slid in a direction to follow the pivot clamp portion 42. Accordingly, the chuck portion 411 and the pivot clamp portion 42 slide on the outer surface of the double pipe 100 toward the first end 101 about the rotation axis P of the rotating portion 41, while holding the double pipe 100 therebetween. As a result, a portion of the double pipe 100 held between the chuck portion 411 and the pivot clamp portion 42 is plastically deformed to be curved about the rotation axis P of the rotating portion 41. The functions of the inner mandrel 2 and the intermediate mandrel 3 in this process are the same as those in the first bending process.

As a result of the bending of the double pipe 100 as described above, the second bent portion 140B is formed in the second area R2 of the double pipe 100. As already described regarding the first bending process, during the bending of the double pipe 100, the inner pipe 110 is axially pulled due to resistance of the inner mandrel 2 and the intermediate mandrel 3, and thus is bent to approach the inward portion of the outer pipe 120 in the curvature radius direction. Specifically, in the second bent portion 140B, the inner pipe 110 has a curvature smaller than a curvature of the outer pipe 120.

In addition, since the inner pipe 110 is bent by the portion forming the joining portion 130 being dragged in accordance with displacement of the outer pipe 120, a part of the inner pipe 110 included in the second area R2 is less likely to be bent as compared with a part of the inner pipe 110 included in the first area R1 because the second area R2 is more distant from the joining portion 130 of the double pipe 100 than the first area R1. In other words, there is a greater tendency in the second bent portion 140B than in the first bent portion 140A that the curvature of the inner pipe 110 is smaller than the curvature of the outer pipe 120.

As described regarding the first bending process, the cross-sectional shape of the outer pipe 120 may also be deformed by the bending. Specifically, a portion of the outer pipe 120 forming the second bent portion 140B has a shape of an irregular circle that is extended along the direction of the rotation axis P.

After completion of the second bending process, the double pipe 100 is taken out of the inner mandrel 2, the intermediate mandrel 3, and the bending die 4. Specifically, first, the inner mandrel 2 and the intermediate mandrel 3 are pulled back to positions not overlapping the second area R2 of the double pipe 100. As a result that the inner mandrel 2 and the intermediate mandrel 3 are pulled from the second area R2 toward the second end 102 of the double pipe 100, the inner pipe 110 is axially extended and the curvature of the inner pipe 110 is reduced in the second area R2. Accordingly, the distance between the inner pipe 110 and the outer pipe 120 inward in the curvature radius direction of the second bent portion 140B becomes further smaller than immediately after the second bending process.

After pulling back the inner mandrel 2 and the intermediate mandrel 3, the pivot clamp portion 42 and the feeder 44 are radially separated from the double pipe 100, and the double pipe 100 is separated from the rotating portion 41 and the slider 43. Also, the feeder 44 is returned to its initial position. After the rotating portion 41 and the pivot clamp portion 42 are returned to their initial positions, the double pipe 100 is taken out of the inner mandrel 2, the intermediate mandrel 3, and the bending die 4.

[2-3. Bent Portion Shaping Process]

As one example, in the configuration of the double pipe 100 designed as a finished product, the inner pipe 110 and the outer pipe 120 each have a perfect circular shape in a cross section perpendicular to the axial direction, and central axes of the inner pipe 110 and the outer pipe 120 coincide with each other. In contrast, in a case of the double pipe 100 after the first bending process and the second bending process, the cross-sectional shape of the outer pipe 120 is deformed by the bending and the position of the inner pipe 110 relative to the outer pipe 120 is biased due to the difference in curvature between the inner pipe 110 and the outer pipe 120, in the first bent portion 140A and the second bent portion 140B. Specifically, the portion of the outer pipe 120 forming the first bent portion 140A has a cross-sectional shape of an irregular circle that is distorted in the curvature radius direction of the first bent portion 140A by the bending. The same applies to a cross-sectional shape of the portion of the outer pipe 120 forming the second bent portion 140B. Also, in the first bent portion 140A, the distance between the inner pipe 110 and the outer pipe 120 is reduced inward in the curvature radius direction of the first bent portion 140A. The same applies to the second bent portion 140B. Thus, the bent portion shaping process is performed subsequent to the first bending process and the second bending process, in order for the double pipe 100 after the bending to have a shape approximated to a desired shape as a finished product. The bent portion shaping process is a process to shape the portions of the outer pipe 120 forming the first bent portion 140A and the second bent portion 140B, in order for the double pipe 100 after the bending to have a shape approximated to a desired shape.

As one example, the bent portion shaping process for the first bent portion 140A is performed first, and thereafter the bent portion shaping process for the second bent portion 140B is performed. However, since the same shaping method is employed for both, a description will be given hereinafter as a process on the bent portion 140 without distinguishing the first bent portion 140A from the second bent portion 140B.

First, as shown in FIG. 4 and FIG. 5, the double pipe 100 is arranged on the first shaping die 51 and the two positioning members 53 in the bent portion shaping device 5. Specifically, the double pipe 100 is arranged such that the bent portion 140 is positioned in the first shaping surface 511 of the first shaping die 51, and the straight portions on both sides of the bent portion 140 are each positioned in the groove 531*a* of the clamp portion 531, on a first shaping die 51-side, of each of the two positioning members 53.

Then, the clamp portion 531, on a second shaping die 52-side, of each of the two positioning members 53 is displaced to approach the corresponding clamp portion 531 on the first shaping die 51-side, and thereby the straight portions on both sides of the bent portion 140 are held by the respective clamp portions 531. As a result, the straight portions on both sides of the bent portion 140 are secured, and the bent portion 140 is located at a position biased outward in the curvature radius direction of the bent portion 140 relative to the first shaping surface 511 of the first shaping die 51 as shown in FIG. 8A. Specifically, the bent portion 140 is located at a position contacting the outward portion of the first shaping surface 511 and separating from the inward portion of the first shaping surface 511 in the curvature radius direction of the bent portion 140.

Figure 9A:
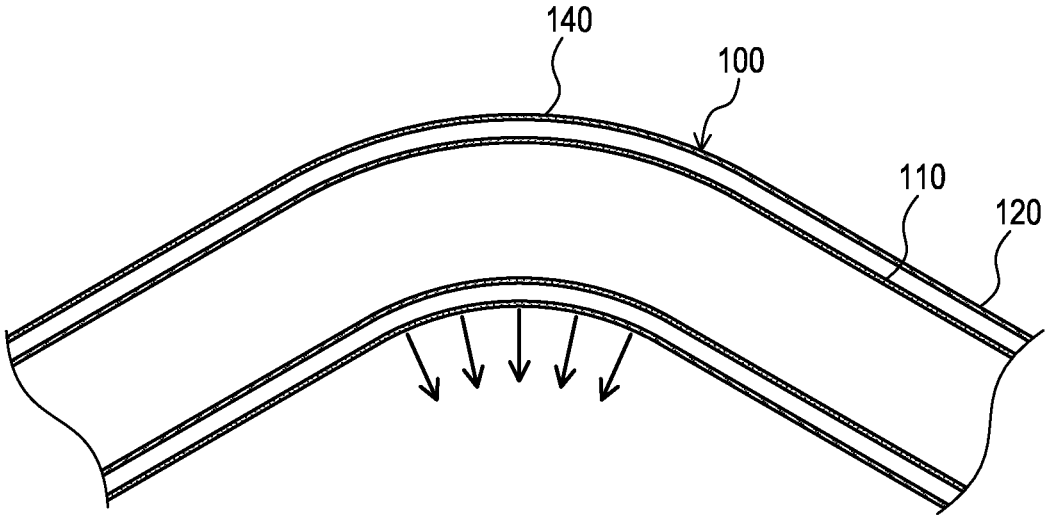
FIG. 9A is a schematic diagram illustrating an area of an outer pipe to be deformed in the bent portion shaping process.

Subsequently, as shown in FIG. 8B, the second shaping die 52 is displaced to approach the first shaping die 51, and the bent portion 140 arranged on the first shaping die 51 is pressed by the second shaping die 52. As a result, the portion of the outer pipe 120 forming the bent portion 140 is distorted in an approaching direction between the first shaping die 51 and the second shaping die 52, while being expanded in the curvature radius direction of the bent portion 140. In the example shown in FIG. 8A and FIG. 8B, the bent portion 140 is arranged to contact the outside surface 511*a* of the first shaping die 51 and to separate from the inside surface 511*b*, and thus the portion of the outer pipe 120 forming the bent portion 140 is expanded inward in the curvature radius direction of the bent portion 140 by being pressed by the second shaping die 52 as shown in FIG. 9A.

In the example shown in FIG. 8A and FIG. 8B, the outside surface 511*a* has a height greater than that of the inside surface 511*b*. Thus, even if the bent portion 140 is arranged at a position biased outward in the curvature radius direction of the bent portion 140 relative to the first shaping surface 511 of the first shaping die 51, it is possible to reduce expansion of the portion of the outer pipe 120 forming the bent portion 140 in the curvature radius direction of the bent portion 140 by being pressed by the second shaping die 52.

While the portion of the outer pipe 120 forming the bent portion 140 is distorted in the approaching direction between the first shaping die 51 and the second shaping die 52, and is expanded inward in the curvature radius direction of the bent portion 140 in this manner, the cross-sectional shape of the outer pipe 120 changes from an irregular circle after the bending toward a perfect circle. Also, the distance between the inner pipe 110 and the outer pipe 120 changes from an uneven distance in the circumferential direction of the double pipe 100 after the bending toward an even distance in the circumferential direction of the double pipe 100. In other words, the shape of the double pipe 100 becomes closer to a desired shape as a finished product.

In this connection, depending on conditions of the bending, the bent portion 140 may have a portion with a reduced distance between the inner pipe 110 and the outer pipe 120 not only inward but also outward in the curvature radius direction of the bent portion 140. For example, the curvature of the inner pipe 110 tends to be smaller than the curvature of the outer pipe 120 by the bending as described above, and if the portion of the double pipe 100 where the bent portion 140 is to be formed is distant from the joining portion 130, then the difference in curvature between the inner pipe 110 and the outer pipe 120 is more likely to be large. Also, if a bending angle of the double pipe 100 during the bending is large, the difference in curvature between the inner pipe 110 and the outer pipe 120 is likely to be large. If the curvature of the inner pipe 110 is smaller than the curvature of the outer pipe 120, and also the difference between the curvatures is large, then the distance between the inner pipe 110 and the outer pipe 120 inward in the curvature radius direction of the bent portion 140 is reduced in a vicinity of an apex of a curve of the bent portion 140, while the distance between the inner pipe 110 and the outer pipe 120 outward in the curvature radius direction of the bent portion 140 is reduced at a position offset from the apex of the curve of the bent portion 140 toward the straight portion adjacent to the bent portion 140. Further, for example, in a case where the inner pipe 110 and the outer pipe 120 have respective apex positions of curves offset each other along the axial directions of the inner pipe 110 and the outer pipe 120, the bent portion 140 may have a portion with a reduced distance between the inner pipe 110 and the outer pipe 120 outward in the curvature radius direction of the bent portion 140 depending on the difference between the apexes.

Figure 9B:
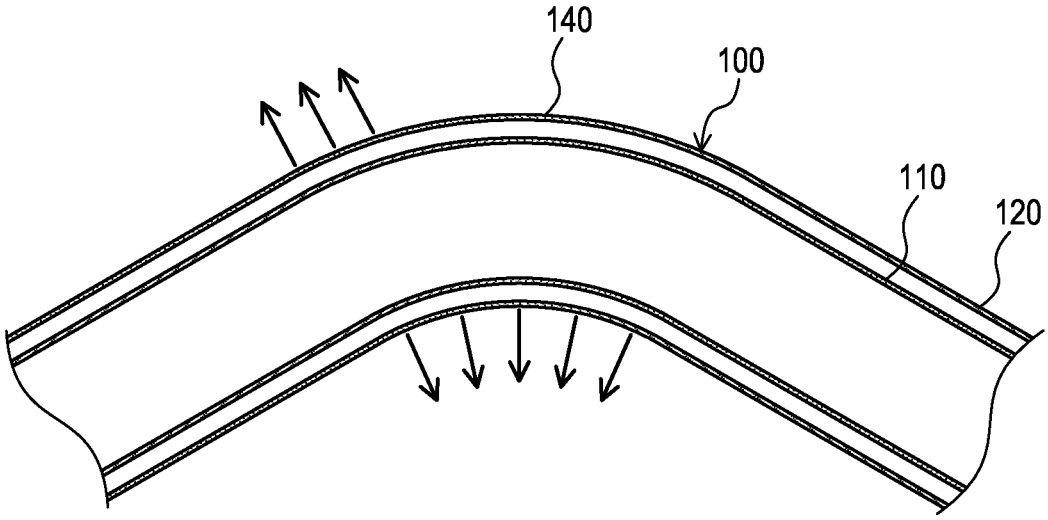
FIG. 9B is a schematic diagram illustrating another example of an area of the outer pipe to be deformed in the bent portion shaping process.

If the bent portion 140 further has a portion with a reduced distance between the inner pipe 110 and the outer pipe 120 outward in the curvature radius direction of the bent portion 140 as described above, a shaping operation is performed, as shown in FIG. 9B, to expand a portion of the outer pipe 120 corresponding to the portion of the bent portion 140 with the reduced distance outward in the curvature radius direction of the bent portion 140. This shaping operation is performed after the aforementioned shaping operation to expand the outer pipe 120 inward in the curvature radius direction of the bent portion 140. In one example, a shaping operation is additionally performed on the second bent portion 140B formed in an area of the double pipe 100 relatively distant from the joining portion 130 so as to expand the outer pipe 120 outward in the curvature radius direction of the second bent portion 140B. In this case, only a shaping operation is performed on the first bent portion 140A so as to expand the outer pipe 120 inward in the curvature radius direction of the first bent portion 140A.

A specific method to expand the outer pipe 120 outward in the curvature radius direction of the bent portion 140 is basically the same as the above-described specific method to expand the outer pipe 120 inward in the curvature radius direction of the bent portion 140. However, when placing the double pipe 100 on the shaping die, the double pipe 100 is arranged not at a position biased outward but at a position biased inward in the curvature radius direction of the bent portion 140 relative to the shaping surface of the shaping die. Accordingly, when the double pipe 100 is pressed by the shaping die, the outer pipe 120 is expanded outward in the curvature radius direction of the bent portion 140, and the distance between the inner pipe 110 and the outer pipe 120 outward in the curvature radius direction of the bent portion 140 is increased. As a result, the distance between the inner pipe 110 and the outer pipe 120 becomes close to an even distance in the circumferential direction of the double pipe 100, and thus the double pipe 100 has a shape approximated to a desired shape as a finished product.

The shaping dies for expanding the outer pipe 120 outward in the curvature radius direction of the bent portion 140 may be the same as or may be different from the shaping die for expanding the outer pipe 120 inward in the curvature radius direction of the bent portion 140 (i.e., the first shaping die 51 and the second shaping die 52). In a case of using any shaping die that is different from the first shaping die 51 and the second shaping die 52, the shaping die may be formed to have a height of an inward portion of the shaping surface in the curvature radius direction of the bent portion 140 greater than a height of an outward portion of the shaping surface. In this case, it is possible to reduce expansion of the portion of the outer pipe 120 forming the bent portion 140 inward in the curvature radius direction of the bent portion 140 as a result of pressing by the shaping die.

3. Effects

According to the embodiment detailed above, the following effects can be obtained.

(3a) The shaping method of the double pipe 100 comprises the first bending process, the second bending process, and the bent portion shaping process. In the first bending process and the second bending process, the bent portion 140 (specifically the first bent portion 140A and the second bent portion 140B) is formed in the double pipe 100. In the bent portion shaping process, the bent portion 140 is arranged on the first shaping die 51 at a position biased outward or inward in the curvature radius direction of the bent portion 140 relative to the first shaping surface 511, and the bent portion 140 arranged on the first shaping die 51 is pressed by the second shaping die 52.

Specifically, in the bent portion 140, the distance between the inner pipe 110 and the outer pipe 120 inward in the curvature radius direction of the bent portion 140 is reduced by the bending, and thus the bent portion 140 is arranged on the first shaping die 51 basically at the position biased outward in the curvature radius direction of the bent portion 140 relative to the first shaping surface 511. However, depending on the conditions of the bending, there may also be formed, in the bent portion 140, an area with a reduced distance between the inner pipe 110 and the outer pipe 120 outward in the curvature radius direction of the bent portion 140. In this case, when shaping such area, such area in the bent portion 140 is arranged on the first shaping die 51 at a position biased inward in the curvature radius direction of the bent portion 140 relative to the first shaping surface 511. Then, the bent portion 140 arranged on the first shaping die 51 is pressed by the second shaping die 52.

In the double pipe 100, the portion of the outer pipe 120 forming the bent portion 140 has a deformed cross-sectional shape, and the position of the inner pipe 110 relative to the outer pipe 120 is biased in the bent portion 140 by the bending. However, according to the aforementioned configuration, the bent portion 140 arranged on the first shaping die 51 is pressed by the second shaping die 52, and thereby the portion of the outer pipe 120 forming the bent portion 140 is distorted in the approaching direction of the first shaping die 51 and the second shaping die 52, and also expanded in the curvature radius direction of the bent portion 140 in the bent portion shaping process subsequent to the first bending process and the second bending process.

Specifically, when the bent portion 140 is arranged on the first shaping die 51 at the position biased outward in the curvature radius direction of the bent portion 140 relative to the first shaping surface 511, the bent portion 140 is expanded inward in the curvature radius direction of the bent portion 140 by pressing by the second shaping die 52. In contrast, when the bent portion 140 is arranged on the first shaping die 51 at the position biased inward in the curvature radius direction of the bent portion 140 relative to the first shaping surface 511, the bent portion 140 is expanded outward in the curvature radius direction of the bent portion 140 by pressing by the second shaping die 52. That is, the bent portion 140 is expanded by pressing by the second shaping die 52 in a direction opposite to a biased arrangement in the curvature radius direction of the bent portion 140 relative to the first shaping surface 511.

Accordingly, by arranging the bent portion 140 on the first shaping die 51 at the position biased in the curvature radius direction of the bent portion 140 relative to the first shaping surface 511, depending on unevenness of the distance between the inner pipe 110 and the outer pipe 120 after bending, and then performing pressing, it is possible to make the cross-sectional shape of the outer pipe 120 approximated to a perfect circle, and to widen the distance between the inner pipe 110 and the outer pipe 120 on a side of the bent portion 140 with a narrower distance to thereby make the distance close to an even distance in the circumferential direction of the double pipe 100. That is, the double pipe 100 can be made to approach a desired shape as a finished product.

(3b) In the first shaping die 51, the height of the outside surface 511*a* is greater than the height of the inside surface 511*b*.

With this configuration, even when the bent portion 140 is arranged to be biased outward in the curvature radius direction of the bent portion 140 relative to the first shaping surface 511, it is possible to reduce expansion of the portion of the outer pipe 120 forming the bent portion 140 outward in the radius direction of the bent portion 140 by being pressed by the second shaping die 52.

(3c) The bent portion 140 is arranged on the first shaping die 51 by using the positioning member 53.

With this configuration, the bent portion 140 can be arranged more accurately at a specified position of the first shaping die 51 than in a case where the bent portion 140 is positioned by a human relative to the first shaping surface 511.

As described above, in the case where the straight portions on both sides of the bent portion 140 are secured by the positioning member 53, it is also possible to reduce positional displacement of the bent portion 140 relative to the first shaping die 51 and the second shaping die 52 during shaping.

4. Other Embodiments

Although one embodiment of the present disclosure has been described above, it should be understood that the present disclosure is not limited to the above-described embodiment, but may be implemented in various forms.

(4a) In the bent portion shaping process, the bent portion 140 is arranged on the first shaping die 51 at the position biased outward or inward in the curvature radius direction of the bent portion 140 relative to the first shaping surface 511. The above-described embodiment shows a case of arranging the bent portion 140 on the first shaping die 51 at the position contacting the outside surface 511*a*, as an example case where the bent portion 140 is arranged biased outward in the curvature radius direction of the bent portion 140 relative to the first shaping surface 511. However, the bent portion 140 arranged biased outward or inward in the curvature radius direction of the bent portion 140 relative to the first shaping surface 511 need not always be arranged on the first shaping die 51 at the position contacting the outside surface 511*a* or the inside surface 511*b*.

(4b) In the above-described embodiment, the bent portion 140 is arranged on the first shaping die 51 by using the positioning member 53. However, the positioning member 53 need not always be used when positioning the bent portion 140 on the first shaping die 51. For example, the bent portion 140 may be positioned by a human.

(4c) In the above-described embodiment, the height of the outside surface 511*a* is greater than the height of the inside surface 511*b* in the first shaping die 51. However, the height of the outside surface 511*a* need not always be greater than the height of the inside surface 511*b*, and the outside surface 511*a* and the inside surface 511*b* may have, for example, the same height.

(4d) In the above-described embodiment, the two bent portions 140 are formed in the double pipe 100. However, the number of the bent portion 140 formed in the double pipe 100 is not limited, and may be one, or may be three or more. In a case of forming two or more bent portions 140 in the double pipe 100, the two or more bent portions 140 may be formed such that the respective central axes X are included in the same plane, or may be formed such that the respective central axes X are included in different planes. In other words, the rotation axes P of the rotating portion 41 when forming the respective bent portions 140 may be mutually parallel or non-parallel.

(4e) In the above-described embodiment, the bent portion shaping process is applied to the bent portion 140 that is obtained through the first bending process and the second bending process. However, the bent portion shaping process may be applied to the bent portion 140 that is formed in the double pipe 100 by a method different from the first bending process and the second bending process exemplified in the above-described embodiment.

(4f) A function served by a single element in the above-described embodiments may be achieved by a plurality of elements, or a plurality of functions served by a plurality of elements may be achieved by a single element. Also, a part of a configuration in any of the above-described embodiments may be omitted. Further, at least a part of a configuration in any of the above-described embodiments may be added to, or replace, a configuration in another of the embodiments.

What is claimed is:

1. A shaping method for a double pipe, the method comprising:

bending the double pipe with a specified curvature to form a bent portion in the double pipe; and arranging the bent portion on a first shaping die that comprises a first shaping surface at a position biased inward or outward in a curvature radius direction of the bent portion relative to the first shaping surface, the first shaping surface being configured to shape a first outer surface of both outer surfaces of the bent portion that are located on both sides of a plane including a central axis of the bent portion, and pressing the bent portion arranged on the first shaping die by a second shaping die that comprises a second shaping surface configured to shape a second outer surface of the both outer surfaces of the bent portion.

2. The shaping method for a double pipe according to claim 1, wherein the bent portion is arranged on the first shaping die at a position biased outward in the curvature radius direction of the bent portion relative to the first shaping surface.

3. The shaping method for a double pipe according to claim 2, wherein the first shaping die comprises an outward portion and an inward portion of the first shaping surface in the curvature radius direction of the bent portion, the outward portion having a height greater than a height of the inward portion.

4. The shaping method for a double pipe according to claim 1, wherein the bent portion is arranged on the first shaping die by using a positioning member configured to position the bent portion relative to the first shaping surface.

5. A shaping device for a double pipe, the device comprising:

a first shaping die that comprises a first shaping surface configured to shape a first outer surface of both outer surfaces of a bent portion formed in the double pipe, the both outer surfaces being located on both sides of a plane including a central axis of the bent portion; and a second shaping die that comprises a second shaping surface configured to shape a second outer surface of the both outer surfaces of the bent portion, the second shaping die being configured to press the bent portion arranged on the first shaping die at a position biased inward or outward in a curvature radius direction of the bent portion relative to the first shaping surface.

* * * * *